United States Patent [19]

Stoll et al.

[11] Patent Number: 4,549,412

[45] Date of Patent: Oct. 29, 1985

[54] FABRIC TAKE-DOWN DEVICE FOR KNITTING MACHINES

[75] Inventors: Thomas Stoll, Reutlingen; Jürgen Ploppa, Pfullingen; Ernst Goller, Reutlingen, all of Fed. Rep. of Germany

[73] Assignee: Stoll GmbH and Company, Fed. Rep. of Germany

[21] Appl. No.: 572,025

[22] Filed: Jan. 19, 1984

[30] Foreign Application Priority Data

Jan. 25, 1983 [DE] Fed. Rep. of Germany ..... 3302523
Dec. 23, 1983 [DE] Fed. Rep. of Germany ..... 3346743

[51] Int. Cl.[4] ..... D04B 15/88
[52] U.S. Cl. ..... 66/149 R
[58] Field of Search ..... 66/149 R, 150, 152

[56] References Cited

U.S. PATENT DOCUMENTS 4,236,390 12/1980 Blank et al. ..... 66/149 R

*Primary Examiner*—Ronald Feldbaum
*Attorney, Agent, or Firm*—Jones, Tullar & Cooper

[57] ABSTRACT

This describes a fabric take-down device (11) for flat knitting machines which is provided with a driving motor (12) and an associated adjusting device (13) to set the torque of the driving motor (12) which determines the take-down pull through the motor current.

In order to provide in a fabric take-down arrangement (11) of this character for a substantial starting and controlled pull, and in particular to cater for a finely-sensitized regulation even in the area of small torque values, provision is made for the adjusting device (11) to be constituted by a motor-current regulating system (26) which is provided with inputs (27, 28, 33, 34, 39) for setting the target figures and for at least one actual value taken from the driving motor (12), and the regulating system (26) further has an input (32) for an augmenting shift pulse for a short-term increase in the torque of the driving motor (12) where there is a small target tongue (FIG. 1).

11 Claims, 6 Drawing Figures

FABRIC TAKE-DOWN DEVICE FOR KNITTING MACHINES

Figure 1:
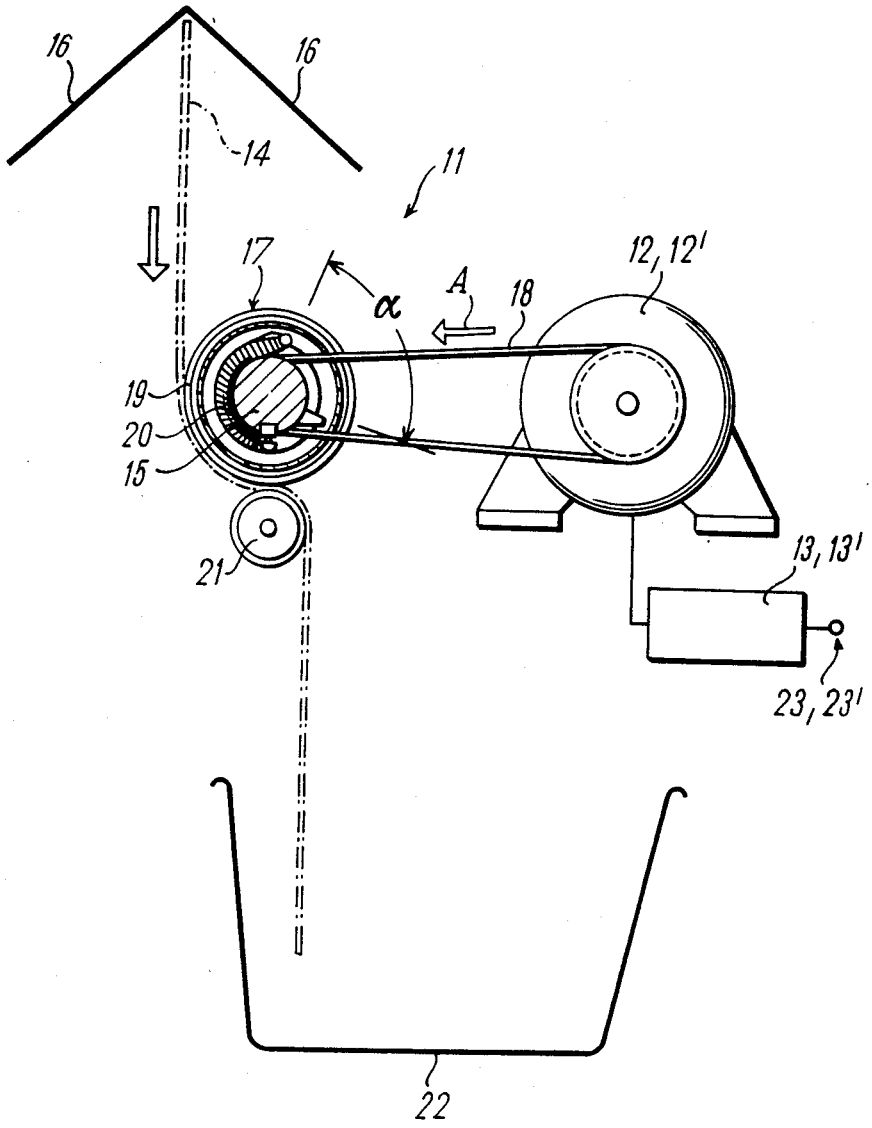

The present invention relates to a fabric take-down device for knitting machines, particularly flat knitting machines, in accordance with the preamble of claim 1.

A fabric take-down device for knitting machines of the type first set forth above is disclosed in German Auslege specification No. 26 31 223. In this take-down device the driving motor is a direct-current motor energised by permanent magnet and the adjusting arrangement, inter alia, is provided with a constant current source and a stepped generator. The requisite pull is set by variation of the intensity of the current flowing through the armature from which it follows that the armature current of the driving motor is stepped. This fabric take-down device is however only able sustantially to ensure a commonly uniform running of the driving device for the knitting means and the fabric take-down mechanism when the driving arrangements for example are switched off. This prior arrangement cannot cope with any initial disturbing phenomena, for example an increase in temperature or the like.

Further, in this prior take-down mechanism the regulation in the realms of small torque is very uncertain and practically impossible when ensuing disturbing factors in the operation, for example the torque due to friction and the like opposing the driving torque and relative to the target torque becomes excessive or even more so.

The object of the present invention is to provide a fabric take-down arrangement for knitting machines and in particular flat knitting machines of the kind set forth in which the substantial disturbing factors set out above can be detected and dealt with and this with a finely-attuned regulation even in the area of a small target torque.

This in fact is achieved in a fabric take-down arrangement for knitting machines, particularly flat knitting machines of the type set forth, by using the features given in the characterising part of claim 1.

In the fabric take-down mechanism of this invention a motor-current regulating system is used in which, by virtue of relatively simple and cost-effective factors using a target value/actual value comparison, an accurate regulation can be implemented in which the substantial potential initial interference quanta are taken into account. The target figure can for example be furnished by a computer in which the data for the fabric take-down involves such factors as the type of knitting, the kind of stitch structure, the width of fabric and the like. As a consequence of the grasping of the important initial fault-inducing quanta any reaction of the instant value of the fabric tension on the motor and on the motor-current regulating system is taken care of which is an additional reason for achieving a very accurate setting and adjusting format.

It is further possible with the fabric take-down arrangement of this invention, where the target figure has a very small torque prescribed for it to make an adjustment within this figure, which would apply for example in the case of a narrow knit width. The target torque figure which remains constant over the whole of the carriage stroke will be augmented by the short-term torque pulse from the shift pulse.

As a result of this temporary increase in the torque the opposing moment, and in particular the subsequent disturbing influences, can positively be overcome. Thus an adjustment of the pull on the fabric by shifting the driving motor and by a mechanical feed the torque pulse is not only relevant when the target torque is very small and less than the oppositely-directed torque moment exerted by the interference influence, but also when the figure is the same or less than this.

The application of the shift pulse results in the take-down roller being temporarily accelerated which may be practicable if the fabric length is not too great. Any excess energy induced in the fabric will be conserved by the stretchability of the latter and eventually will come into effect when normal working is restored with normal torque prevailing. If any mechanical feed have to be sought, as for instance might be if a stretch capacity beyond that of the particular fabric involved, then in accordance with a further feature of the invention in accordance with claims 10 and 11 the take-down roller is made as two relatively movable parts connected by tension-spring means thereby forming a feeder means.

It is also apparent from this that, independently of feeder means, it is possible, based on the fabric width and other parameters, either to use the shift pulse as a knitting reversal pulse applied only where the carriage is turned round and/or to apply this shift pulse at required times, and certainly when the mechanical feed has become empty.

This shift pulse is advantageously variable in duration and/or degree so that it can be selected independently of the target torque figure and of the mechanical feed data the energy content of which is selectable.

As indicated in claims 5 and 9 a rotary field motor or a direct-current motor can be used for driving the motor.

Figure 2:
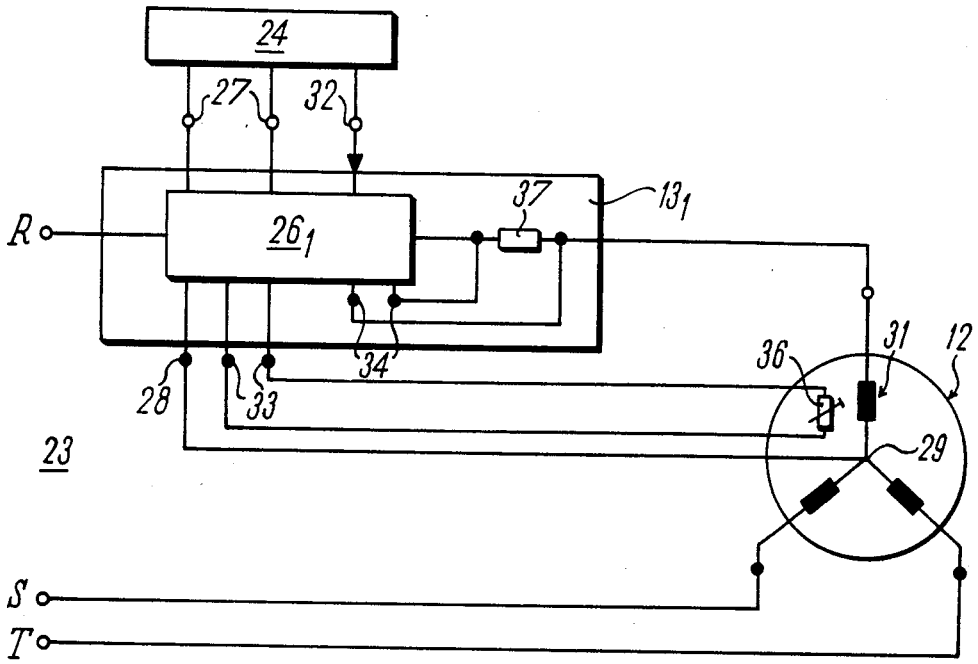
Figure 3:
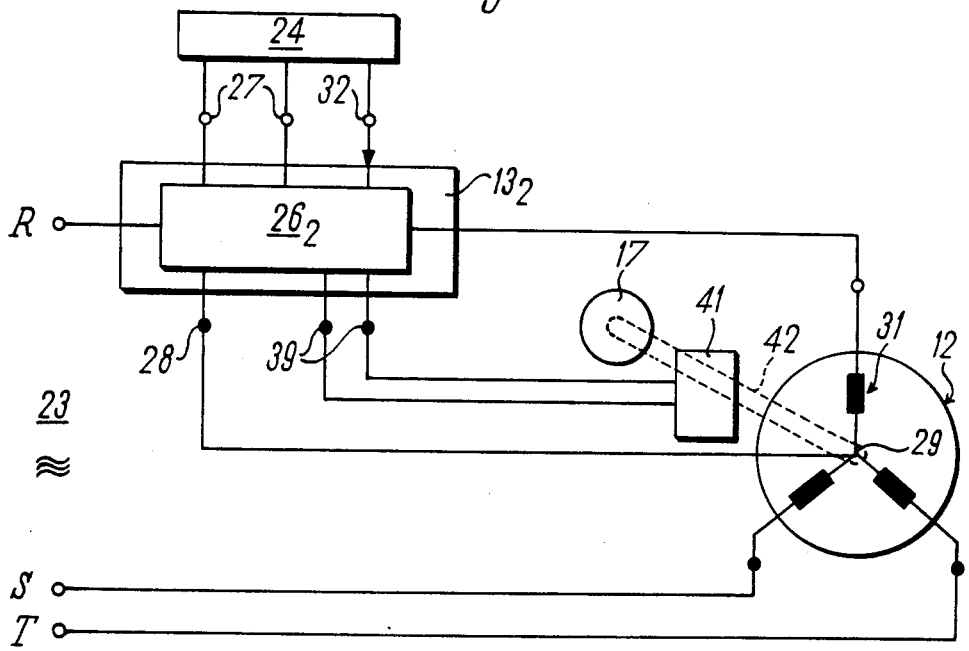
Figure 5:
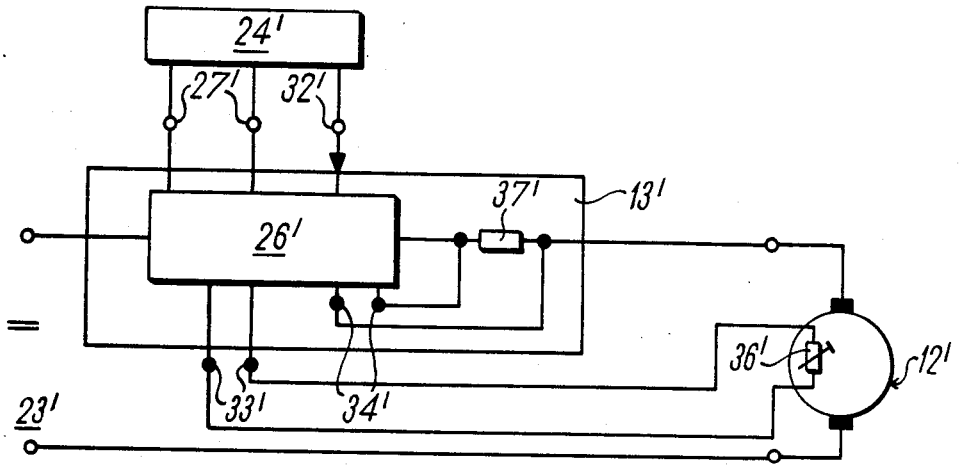
Figure 4:
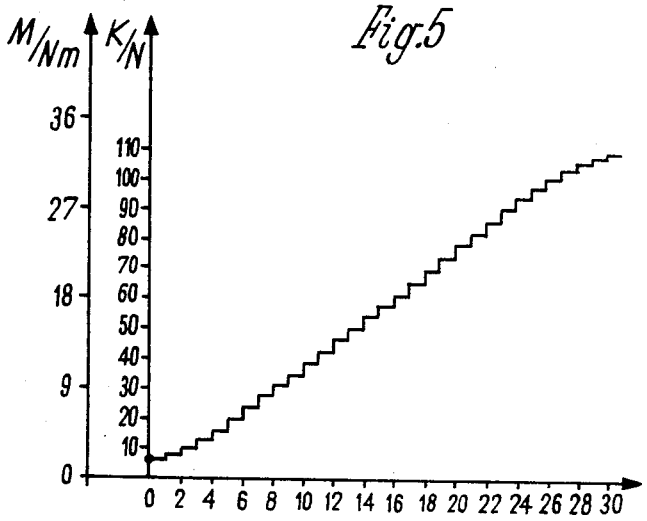
Figure 6:
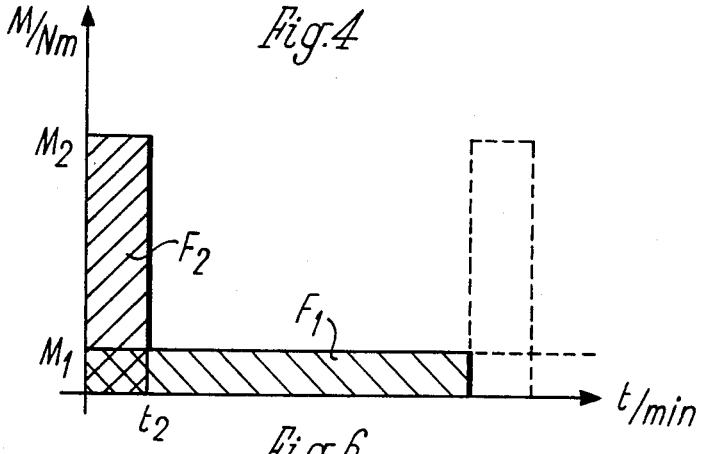

Further details and features of the invention are to be found in the following description of an example of embodiment thereof illustrated in the accompanying drawings, in which:

FIG. 1 is a diagrammatic representation from the side of a take-down mechanism incorporating an adjusting device, FIG. 2 gives a circuit diagram of an adjusting device for fabric take-down mechanism in an embodiment of the invention, FIG. 3 the circuit diagram of an adjusting device for fabric take-down mechanism in another embodiment of the invention, FIG. 4 the diagram of a characteristic torque curve, FIG. 5 the wiring system of a device for adjusting the take-down mechanism in a further embodiment of the present invention, and FIG. 6 the diagram of a torque characteristic curve taken in relation to time.

The fabric take-down mechanism 11 in accordance with this invention provided with an electrical adjusting device 13 or 13' which operates directly on a driving motor 12 or 12' serves to adapt the fabric take-down to the type of knitting that is to the stitch structure, and the like, to the number of needles, that is to say the fabric width, and so on so providing a delicately controlled regulation. This is to be independent of the size of any disturbing external factors such for example as mains voltage fluctuations, temperature increases in the motor and the like. This sensitive regulation is to apply particularly in the small torque environment.

FIG. 1 depicts in diagram a fabric take-down mechanism 11. The fabric 14 falls vertically from the needle bed 16 and meets a take-down roller 17 tangentially. This roller has a through shaft 15 mounted rotatably (by means not shown) in the machine frame and is driven in the direction shown by the letter Aby means of a driving belt 18 from driving motor 12. Gearing (not shown) may be interpolated in this drive. Lined up on the shaft 15 of the take-down roller 17 are a plurality of side-by-side roller elements 19 which are rotatable a predetermined fixed maximum angular amount $\alpha$, against the action of a mechanical feeder, here in the form of tension spring 20, relatively to the shaft 15. The arrangement is such that during a rotation in the direction of arrow A if the driving torque is more than can be taken by the roller element 19 because of the applied fabric web 14 there may be an acceleration of the shaft 15 relatively to the shaft element 19 until the aforesaid maximum angle $\alpha$ may be reached. The same effect of a mechanical feeder is also provided by the extensibility of the fabric web 14 being taken down, whereby this advantageously takes effect before that of the tension spring of the take-down roller. Counter to the roller elements 19 of the take-down roller 17 uniformly spread over its length are press rollers 21 urged by means not shown, the fabric web being guided and reversed between the press rollers 21 and the take-down roller. The fabric web 14 either passes into a collecting container 22 or to a winding up unit (not shown). The driving motor may for example be a three-phase rotary field motor 12 or a direct-current motor 12'. Similarly the voltage source 23 or a constant direct current voltage source 23' can be used.

In the embodiment illustrated in FIGS. 2 and 3 the driving motor 12 is connected to a rotary current, voltage source 23 in three-phase fashion, such that in one phase or in one row (for example in phase R) the electrical adjusting device $13_1$ or $13_2$ is set to adjust the pull of the take-down, that is to say the torque of the motor in accordance with a prescribed target and with an elimination of interfering factors. The driving motor 12 is an asynchronous motor with a three-stage operation and having a short circuiting cursor at the centre, this centrepoint floating and not fixed.

The electrical adjusting device $13_1$ or $13_2$ is arranged in phase R of the three-phase conduit to the driving motor 12. The adjusting device $13_1$, $13_2$ comprises a phase-discriminating circuit $26_1$ or $26_2$ which is in series with phase R, dependent on a torque value, determines the size of the voltage to be fed in this phase to the driving motor by an arrangement in which, in each positive and/or negative half shaft of the alternating voltage a specific angular range is impressed. The target figure which is applied at the input terminal 27 of the phase discrimination system $26_1$ or $26_2$ is for example derived from a computer or like data-processing system 24 which, depending on the type of knitting and the number of needles, determines the parameters, namely the rate and tension, of the take-down effort. Further what is common to FIGS. 2 and 3 is that the phase-discriminating systems $25_1$ and $26_2$ of the adjusting devices $13_1$ and $13_2$ are provided with an input 28 in which the centre 29 to which the circuit centre of the stator windings 31 are connected. In addition there is an input 32 through which a shift or knitting reversal pulse is applied potential-free, the function of which will be described below. The inputs for the detected instant figure of the driving motor 12 are different in the two examples of FIGS. 2 and 3.

In the embodiment illustrated in FIG. 2 the phase-discrimination circuit $26_1$ of the adjusting device $13_1$ two instant-value inputs 33 and 34 one of which has fed thereto the actual value of the motor temperature whilst to the other is sent the instant value of the current in phase R or a coordinated figure. The instantaneous actual figure for the motor temperature is taken from a temperature-surge detector 36 disposed in the stator of the driving motor 12, that is in the vicinity of the stator winding 31. The instant value of the current in phase R is taken from the voltage drop at a resistance 37 in the phase R network.

In the embodiment of FIG. 1 the phase discrimination regulating system $26_2$ of the adjusting device $13_2$ is provided with a single instant value input 19 to which the instant value of the torque of the driving motor is applied. The instant torque is taken at a torque detector 41 arranged on the driving shaft 42 of the driving motor 12 to the take-down roller 17.

The function of the adjusting devices $13_1$, $13_2$ in both embodiments is as follows: depending on a specifically prescribed target figure in regard to the rate and stress of the fabric take-down, and thus on the torque of the driving shaft 42 of the driving motor 12, there is a specific cutout from phase R provoked by the circuits $26_1$, $26_2$ so that a specific voltage reduction relatively to the applied voltage is applied in this phase to the driving motor 12. With a variation of the prescribed target figure there follows a corresponding variation of the phase cutout and with it a variation in the motor voltage in phase R, which results in a speed or torque reduction for motor 12. If along with a constant target prescription changes occur in the other internal and external data these will be reflected either by a change in the phase current and/or in the motor temperature or in torque factors which can arise from fluctuations in feed voltage, changes in room temperature, variations in load stress and the like, these effects then being imported to the relevant inputs of the phase discrimination regulating station $26_1$, $26_2$. Here there will be a comparison with the target figure with a consequent variation in the phase cutout and thereby a change in the torque demand on the driving motor 12.

If now working with a small number of needles, that is to say a narrow fabric width a relatively small torque target is required for the take-down of the fabric which in the zone of the oppositely directed torque may be produced from the geared roller friction or the like may thus be more or less than this. It must then be ensured that even in the case of this smaller torque prescription the arrangement is finally controlled or adjusted and a renewed acceleration of the driving motor can and must be possible from this very small rotational speed. For this reason a shift or knitting reversal pulse is applied at the input 32 on the stroke reversal of the carriage and/or during the stroke of the carriage.

FIG. 6 indicates the torque in relation to time, during the effecting of the shift or knitting reversal pulse. The block $F_1$ shows the energy which is applied during a specific torque $M_1$ during a stroke of the carriage. If the extent of this torque $M_1$ lies close or actually beneath the value which is sufficient to overcome the frictional moment of the motor, gearing or the like, so a further fine adjustment of the torque is no longer needed or is of no effect. This energy feed can, as the block $F_2$ indicates, can result from the fact that during a specific period $t_2$ a relatively greater torque pulse is applied which in any case is substantially above the moment previously referred to of the sum of the interference elements to be overcome. This temporary pulse which during the carriage reversal and/or during the stroke of the carriage is imposed through the input 32 is adjustable both in size and also in length and thus selectable. This temporary torque pulse is transmitted from motor 12 to the shaft 15 of the take-down roller 17. The resultant torque speed resulting from this is however greater than that applied to the fabric web 14 being taken down so that the roller elements 19 are not able to participate in this angular speed. This means that the shaft 15 turns relatively against the action of the tension springs 20 faster. By this means the tension springs 20 are pulled out and the mechanical feed resulting from this is imposed. A similar mechanical feed is to be found in the fabric web 14 because this has a certain elastic extensibility. Thus a further, if smaller mechanical feed is found in the stretching of the individual stitches of the fabric web 14 which, based on the tension of the springs advantageously is imposed before the feed by the roller 17. What now results is that, the torque required to take down the fabric web 14 during a stroke of the carriage or the proportion of the torque required to overcome the opposed interference torque are prescribed by one or both mechanical feed means, and that the mechanical feed is relieved slowly by the fact that the energy imposed on the take-down roller 17 is terminated. It will be understood that the shift pulse to provide this temporarily increased torque must appropriately be adjudged in degree and period. By this means also in the instance of relatively small torques, depending on the parameter of the mechanical feed effort expended a finely prescribed target figure is possible. Correspondingly however this finely-adjudged regulation is not only required for small torques but also in the case of acceleration or sudden precipitant increase in the rate of the driving motor. It will be understood that this shift pulse must only be applied for a specific minimal period to be able to be effective through the regulation system at the starting up of the motor.

The shift pulse can be periodically and continuously imposed, the resulting torque can however only be of a size which ensures that this pulse only comes into effect when a torque target value is in the area of the interfering impulse and thus plays no role if the torque target value is greater. However features may be provided to suppress this knitting reversal pulse when the prescribed target value of the torque is equal to zero because there is then no need to apply shift to the driving motor 12.

The prescribed target value can be either of an analogue or digital type. In the case of a digital prescribed target figure, as in the embodiment illustrated in FIG. 3, the torque curve shown in FIG. 4 is for example divided into 30 scale parts, the appropriate digital value corresponding directly in the scale part of the same number and thus at a specific torque.

In the embodiment illustrated in FIG. 5 the driving motor is a direct current disc motor 12' connected to the direct current source 28' whereby in one feed conduit the adjusting device 13' is arranged. This adjusting mechanism 18' is also provided with a motor or armature current regulating system 26' which is provided with two instant value inputs 33' and 34', one of which detects the instant value of the motor temperature, which is detected by means of the temperature detector 36', and the other of which is fed with the instant value of the armature current or a value derived from this, namely the voltage drop at the resistance 37' in the feed conduit. The armature current regulating system 26' is also in this embodiment provided with input terminals 27' to which the torque target value, for example is applied from a calculator 24' dependent on the type of knitting, the number of needles, the size, that is to say the speed and pull of the fabric take-off means and the like. In addition this regulating means 26' has an input 32' through which a supplementary or knitting reversal pulse is applied from a calculator 24', the function of this pulse being described in reference to the embodiment of FIGS. 2 and 3 of the drawings.

It will be understood that instead of the asynchronous motor described with reference to FIGS. 2 and 3 with its short circuit fitting, other rotary field motors 12 and instead of the direct current discs described in connection with FIG. 5 other direct current motors 12' can be used.

The driving motor 12 or 12' additionally comprises, and this is not illustrated in the accompanying drawings, a mechanical one-way brake in the form of a rotary toothed stop to prevent the motor running back when cut off or when the pull is terminated.

Further, and this is also not illustrated, the fabric take-off arrangement 11 is provided with a supervising device which watches the maximum rotary speed of the take-down roller 17 or of the driving shaft 42 of the motor 12 or its gearing. For example a part of this supervising device is a cam connected to the take-down roller 17 and which cooperates with a fixed switch controlled by a clock. If the take-down roller 17 and with it the cam turns too fast this will engage the switch having the timing clock and which will result in a switching off of the driving motor 12 and the complete knitting machine. This too-rapid rotation can occur when the knitted fabric drops, that is to say when there is no pull in the fabric take-off arrangement. From the starting of the driving motor 12 referred to above from being stationary and during the operation of the complete flat knitting machine a defect to be eliminated may occur on the basis of a cutting out of the flat knitting machine as a result of a defect, for example tearing or the like of the knit. Normally when the flat knitting machine is started again the driving motor of the fabric take-down mechanism would be implemented up to its full torque, but this has the disadvantage that the knit would be pulled too hard because in the first place at this time there would be no new row of stitches knitted and in the second place it would lead to an excessive pull and thus a temporary higher torque would be produced. To prevent this a switch circuit is provided in the motor current regulating circuit 26, 26' to cater for a slow speed increase of the take-down roller 17 or the driving motor 12, 12' thereof to provide for an instant torque calculated for this condition from a stationary condition when the flat knitting machine is switched on again and there is thus for example a fresh switching impulse applied. During this increased speed the phase cutout angle or the armature current is increased up to the prescribed nominal or required figure so that not only is the torque brought slowly to the prescribed figure but also any excess is prevented. This is particularly important in the case of a momentary target value in the middle and upper torque range.

We claim:

1. A fabric take-down mechanism for a knitting machine, comprising a take-down component, a motor operative to drive said take-down component, said motor producing an output torque, and a torque-adjusting device operative to adjust said output torque of said motor to control said take-down component, said torque-adjusting device including a motor regulating system having control inputs, transmitting means operative to transmit to said control inputs a target torque figure and at least one instant torque value from said motor, and further inputs for receiving an electrical shift pulse to vary said output torque.

2. The fabric take-down mechanism according to claim 1, further comprising means to vary the characteristics of the shift pulse and to apply the shift pulse in response to travel of a carriage of said knitting machine.

3. The fabric take-down mechanism according to claim 1, wherein said motor comprises a three-phase rotary field motor, and said torque-adjusting device comprises a single-phase phase discrimination system.

4. The fabric take-down mechanism according to claim 3, wherein said single-phase phase discrimination system comprises a first input to receive a measurement through a resistance of the prevailing current to said motor, and a second input to receive a measure of the prevailing temperature of the motor.

5. The fabric take-down mechanism according to claim 4, wherein said rotary field motor is an asynchronous motor incorporating a short-circuit rotor, and has a stator winding whose centre point is floating and is connected to one of said inputs of said phase discrimination system.

6. The fabric take-down mechanism according to claim 1, wherein said motor is of a direct current disc rotor type, and said torque-adjusting device comprises an armature current regulating system.

7. The fabric take-down mechanism according to claim 1, further comprising mechanical means to assist feeding of a fabric being taken down by said take-down component, said mechanical means being controlled by a shift pulse greater than that required for normal take-down.

8. The fabric take-down mechanism according to claim 7, wherein said mechanical means comprises a driving shaft, at least one roller rotatable relative to said driving shaft and disposed in contact with a web of said fabric being taken down, and a tension spring connected between said driving shaft and said at least one roller.

9. The fabric take-down mechanism according to claim 1, further comprising digital means to compute said target torque figure.

10. The fabric take-down mechanism according to claim 1, further comprising analogue means to compute said target torque figure.

11. The fabric take-down mechanism according to claim 1, further comprising monitoring and controlling means to monitor the rate of fabric take-down and to control the rate of operation of the instrumentalities involved in response to the rate thus monitored.

* * * * *